US007840147B2

(12) United States Patent
Morikuni

(10) Patent No.: US 7,840,147 B2
(45) Date of Patent: Nov. 23, 2010

(54) IMAGE FORMING APPARATUS AND METHOD FOR CONTROLLING IMAGE DENSITY THEREOF

(75) Inventor: Shuichi Morikuni, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 833 days.

(21) Appl. No.: 11/799,366

(22) Filed: Apr. 30, 2007

(65) Prior Publication Data

US 2007/0286622 A1 Dec. 13, 2007

(30) Foreign Application Priority Data

May 16, 2006 (JP) ..... 2006-136746

(51) Int. Cl.
*G03G 15/00* (2006.01)

(52) U.S. Cl. ..... 399/49; 399/72

(58) Field of Classification Search ..... 399/49, 399/72

See application file for complete search history.

(56) References Cited

U.S. PATENT DOCUMENTS 5,708,916 A * 1/1998 Mestha ..... 399/49
6,650,849 B2 11/2003 Shimura

FOREIGN PATENT DOCUMENTS

| | | |
|---|---|---|
| JP | 10-239924 | 9/1998 |
| JP | 2002-214852 | 7/2002 |
| JP | 2006-003816 | 1/2006 |

* cited by examiner

*Primary Examiner*—William J Royer
(74) *Attorney, Agent, or Firm*—David G. Conlin; Steven M. Jensen; Edwards Angell Palmer & Dodge LLP

(57) ABSTRACT

An image forming apparatus for stabilizing image densities of a high-density image by devising shapes of test patches is provided. A test pattern image is created by adhering toner to a plurality of test patches having respectively different line area rates of 100% or less. An amount of adhering toner for a line area rate of 100% is calculated by detecting the amount of the toner adhering to the test pattern image. Then, process conditions are controlled so that the calculated amount of the adhering toner reaches a predetermined value. By doing so, the amount of the adhering toner of the high-density image is accurately controlled.

10 Claims, 5 Drawing Sheets

【Fig.1】
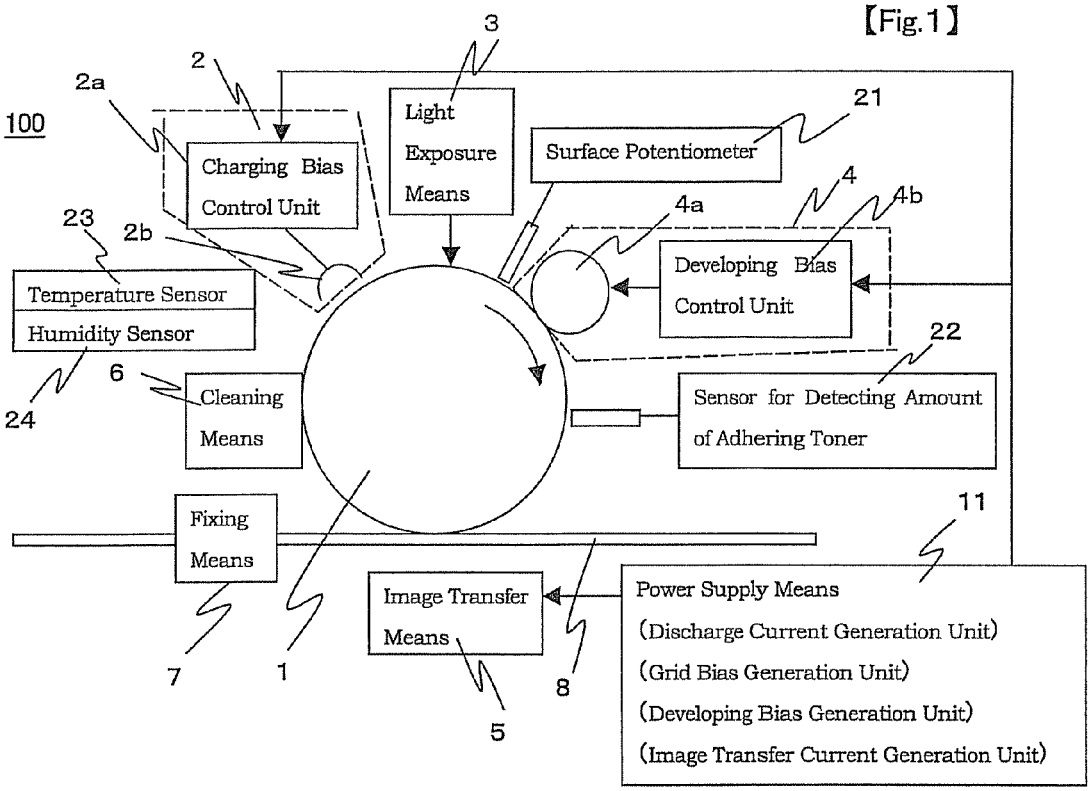
【Fig.2】
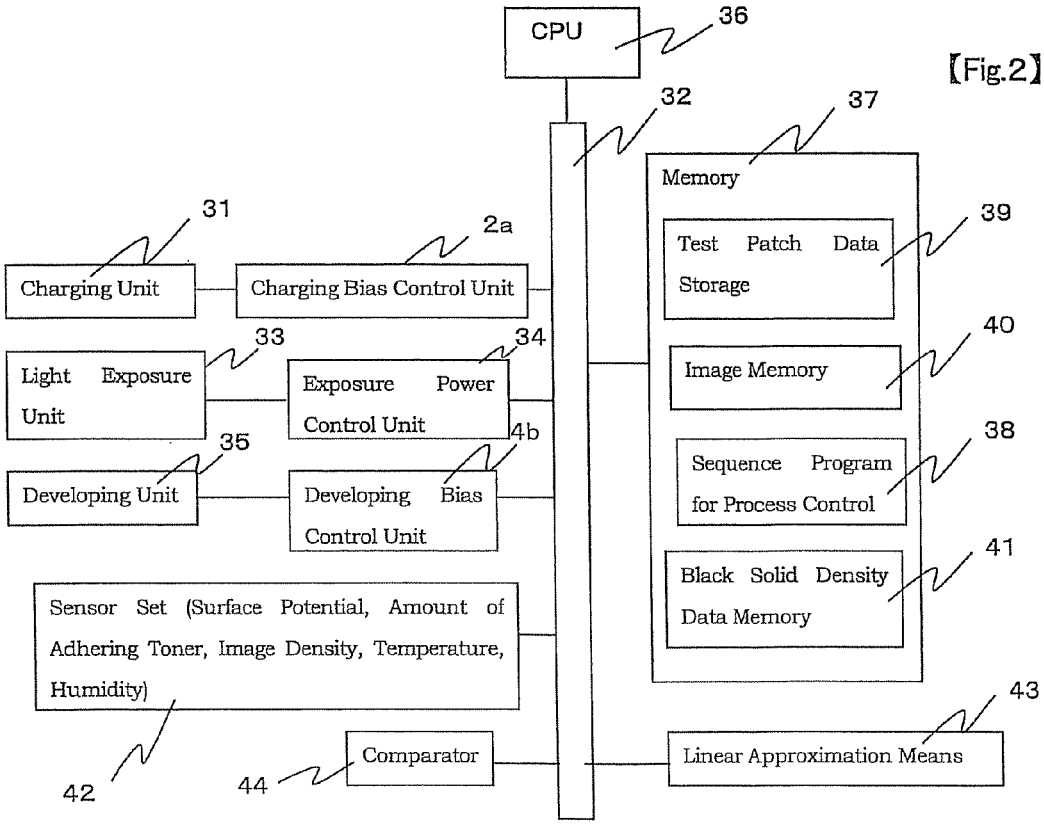

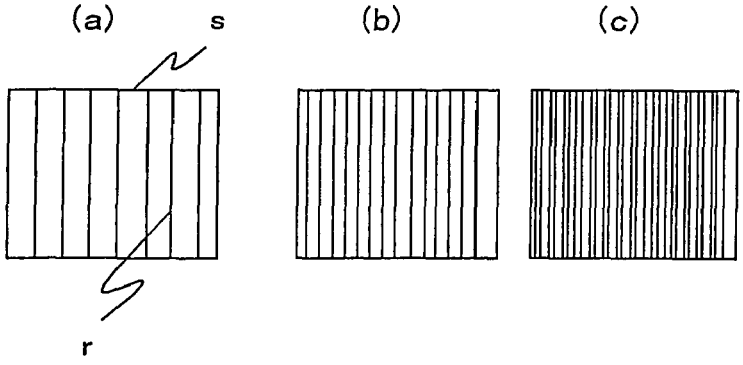
【Fig.3】

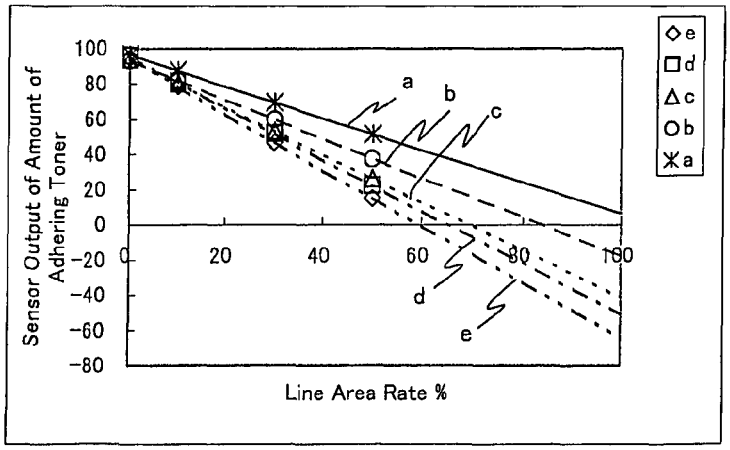
【Fig.4】
(a)
【Table1】
(b)
| | e | d | c | b | a |
|---|---|---|---|---|---|
| Developing Bias Vb V | -375 | -350 | -325 | -300 | -275 |
| Approximated Values of Sensor Outputs for Line Area Rate of 100% | -64.5 | -51.0 | -41.3 | -18.1 | 6.6 |
| Amount of Adhering Toner for Line Area Rate of 100% (mg/cm2) | 0.80 | 0.66 | 0.53 | 0.40 | 0.15 |
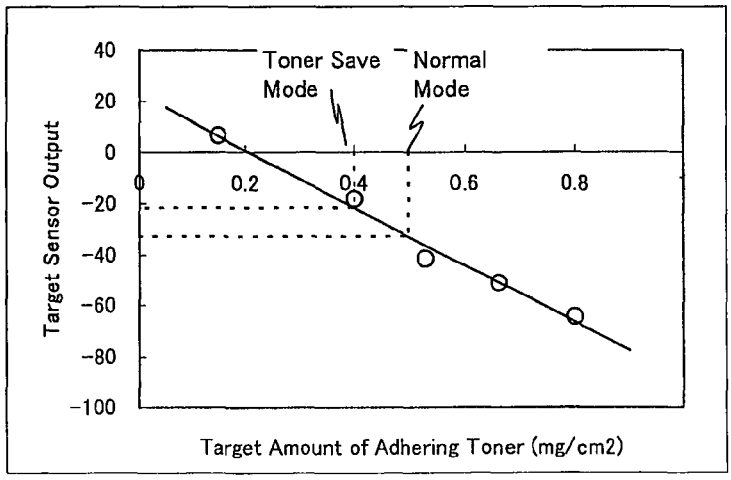
【Fig.5】

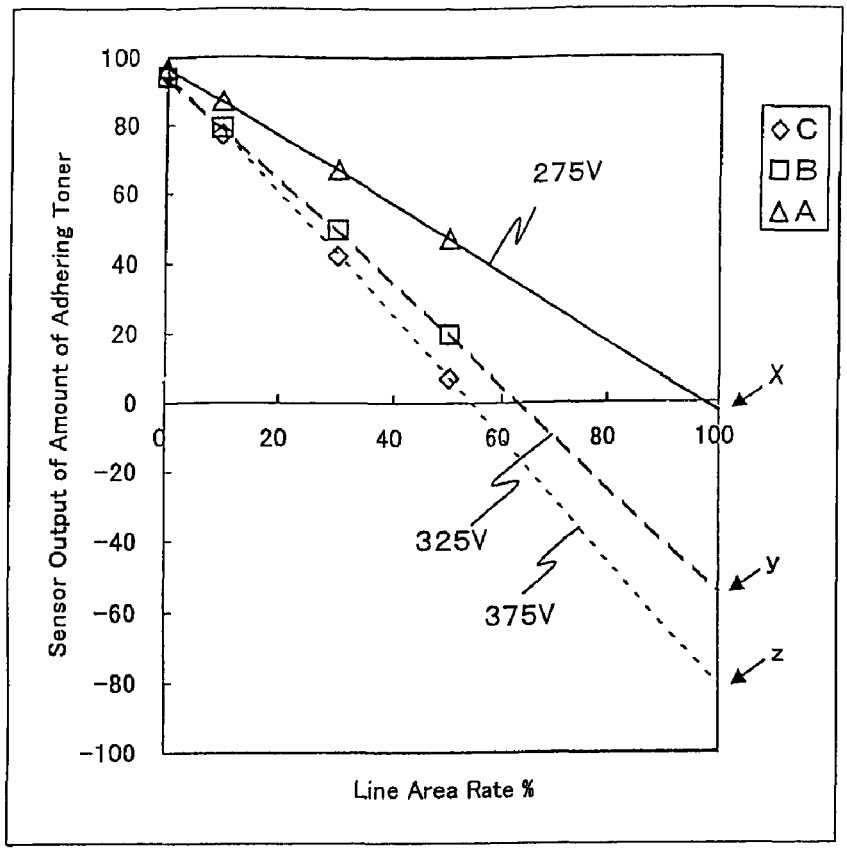
【Fig.6】
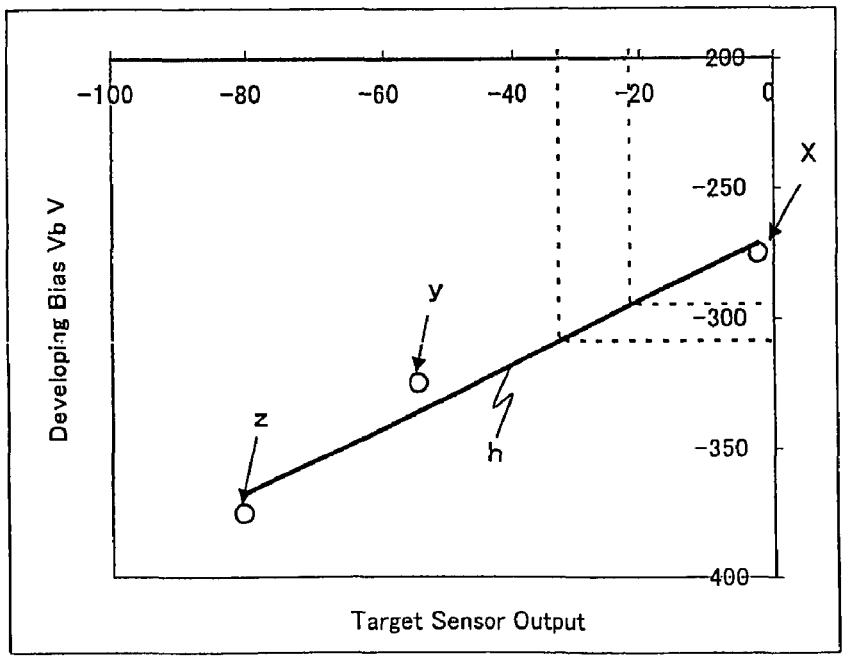
【Fig.7】

【Fig.8】
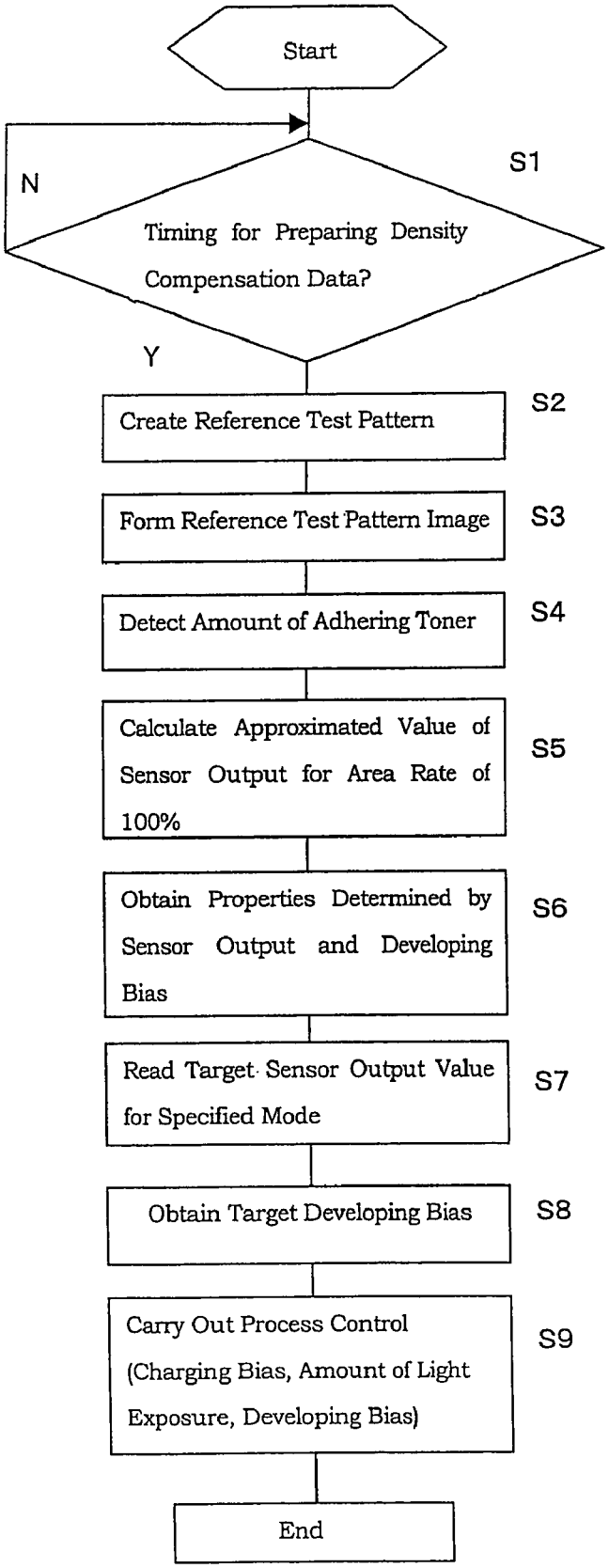

IMAGE FORMING APPARATUS AND METHOD FOR CONTROLLING IMAGE DENSITY THEREOF

CROSS-REFERENCE TO RELATED APPLICATION

This application is related to Japanese Patent Application No. 2006-136746 filed on May 16, 2006, whose priority is claimed and the disclosure of which is incorporated by reference in its entirety.

BACKGROUND OF THE INVENTION

1. Field of the Invention

The present invention relates to an image forming apparatus that forms an electrostatic latent image by exposing a surface of a photoconductor with a light beam, visualizes the electrostatic latent image by using toner, and fixes the electrostatic latent image on recording paper by the toner, and a method for controlling an image density of the image forming apparatus. Particularly, the present invention relates to an image forming apparatus that stabilizes the amount of adhering toner or densities of a high-density image.

2. Description of Related Art

In image forming apparatuses, the amount of toner adhering to an image varies depending on the individual apparatuses, a change with time or fatigue of a photoconductor and the toner, a change in temperature and/or humidity around the apparatus, or others. Taking this into account, conventional techniques for obtaining optimal values of a charging bias and a developing bias to stabilize image densities have been proposed (for example, Japanese Unexamined Patent Publication No. Hei 10-239924).

Japanese Unexamined Patent Publication No. 2002-214852 discloses a technique for stabilizing image densities of toner images in a wide density range. According to this technique, solid patch images are formed under various conditions for preparing patches, optical densities of the respective patch images are measured by a patch sensor, and higher-density side correlation data matching to a higher-density side target density and lower-density side correlation data matching to a lower-density side target density are collected from measurement data. Then one piece of correlation data is obtained that belongs to a product set of the higher-density side correlation data and the lower-density side correlation data. From the correlation data, an optimal exposure energy and an optimal developing bias are determined.

Japanese Unexamined Patent Publication No. 2006-003816 discloses a technique for solving a problem that appropriate density compensation data cannot be obtained due to variations of dots and densities on image data of a test pattern, the variations caused by a variation based on gradation expressions of the test pattern. With this technique, a reference test pattern which is expressed by the gradation expressions of a dot array and/or a dot size expressing a single pixel is formed on an image carrier, the image density of the reference test pattern is detected, and the density compensation data is prepared on the basis of the detected density.

Both techniques in the above publications, Japanese Unexamined Patent Publication Nos. Hei 10-239924 and 2002-214852, are to form black solid patches on a photoconductor and to detect densities of the black solid patches. In Japanese Unexamined Patent Publication No. 2006-003816, a plurality of rectangular images of the same density are arranged to form a gradation image and respective densities of the gradation images are gradually changed to form an image as a density pattern.

When black solid patches are formed, however, the black solid patches absorb light and cause a decrease in sensitivity of a sensor. When it comes to black solid patches of moderate-density, which are formed by modulating the pulse width of light exposure and the density of the solid patches of the moderate-density is detected by a density sensor, the density of the black solid patches is changed by stains on the sensor or the long-term-use of the sensor such as the sensor's life span. Also, the black solid patches consume a larger amount of toners and they are problematic. Regarding Japanese Unexamined Patent Publication No. 2006-003816, another problem has been identified that kinds of the reference test pattern are limited.

SUMMARY OF THE INVENTION

In order to solve the above-described problems, the present invention provides an image forming apparatus for stabilizing image densities of a high-density image by devising shapes of test patches, and a method for controlling the image densities of the image forming apparatus.

The present invention provides an image forming apparatus comprising: a test pattern image creation unit for creating a test pattern image by adhering toner to a plurality of test patches having respectively different line area rates of 100% or less; a detection unit for detecting an amount of the toner adhering to the test pattern image; a calculation unit for calculating the amount of the adhering toner for the line area rate of 100%, based on the amount of the adhering toner detected by the detection unit; and a control unit for controlling process conditions so that the amount of the adhering toner obtained by the calculation unit reaches a predetermined value. By doing so, the amount of the adhering toner of a high-density image can be accurately controlled and stabilized. Also, toner consumption can be reduced.

The image forming apparatus of the present invention is desirable to provide the test patch comprises two or more test patches having respectively different line area rates of 50% or less. By doing so, the amount of the adhering toner can be calculated for the line area rate of 100%. Moreover, since the line area rates are 50% or less, linearity of the amount of the adhering toner and a sensor output of the amount of the adhering toner can be ensured to prevent poor accuracy caused by degradation of the linearity of the sensor output.

Also, in the image forming apparatus of the present invention, it is desirable that a line direction composing the test patches is approximately in a subscanning direction of the image forming apparatus. By doing so, a test pattern can accurately compensate image densities without being affected by top end or bottom end chipping.

Further, in the image forming apparatus of the present invention, it is desirable that lines composing the test patches comprise two to ten dots in width. By doing so, toner consumption can be reduced. The lines of the test patches are preferable to comprise five dots or less in width.

Furthermore, in the image forming apparatus of the present invention, it is desirable that a plurality of the test pattern images are arranged corresponding to a plurality of sensors for the amount of the adhering toner, disposed in a width direction of the photoconductor. By doing so, the amount of the toner adhering to the test pattern images can be accurately measured.

Moreover, in the image forming apparatus of the present invention, it is desirable that the calculation unit calculates the amount of the adhering toner for the line area rate of 100% by linear approximation based on the amount of the adhering toner detected by the detection unit. By doing so, the linear approximation is simple and accurate and can be carried out to control the amount of the adhering toner of the high-density image.

In addition, in the image forming apparatus of the present invention, it is desirable that the process conditions are at least one of developing bias, photoconductor charge potential, exposure energy, and image transfer current. By doing so, the image forming apparatus can accurately compensate the image densities.

In another aspect of the present invention, a method for controlling an image density is provided for an image forming apparatus and includes: a creation step for creating a test pattern image by adhering toner to a plurality of test patches having respectively different line area rates of 100% or less; a detection step for detecting an amount of the toner adhering to the test pattern image; a calculation step for calculating the amount of the adhering toner for the line area rate of 100%, based on a result of the detection step; and a control step for controlling process conditions so that the amount of the adhering toner obtained in the calculation step reaches a predetermined value. By doing so, the amount of the adhering toner or the image densities of a high-density image can be accurately controlled and stabilized. Also, toner consumption can be reduced.

It is desirable that the method for controlling the image density of the image forming apparatus of the present invention is carried out at timing of process control. By doing so, the image densities can be stabilized.

A computer program of the present invention is a computer program accessible from the computer to implement each of the above steps.

By using the image forming apparatus of the present invention, the amount of the adhering toner of the high-density images can be highly accurately stabilized. Moreover, according to the present invention, the amount of the adhering toner of the high-density images can be controlled to reach a predetermined value. Also, the toner consumption used for the test pattern can be reduced.

These and other objectives of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1 is a configuration of an image forming apparatus of the present invention;

FIG. 2 is a block diagram of an image forming apparatus of the present invention;

FIGS. 3(*a*) to 3(*c*) are drawings for explaining test patches of the present invention;

FIGS. 4(*a*) and 4(*b*) are a graph and a table, respectively, showing a relationship between a line area rate of test patches and a sensor output of an amount of adhering toner of the present invention;

FIG. 5 is a graph showing a relationship between approximate values of a sensor output of an amount of adhering toner and an amount of adhering toner for a line area rate of 100%;

FIG. 6 is a graph showing properties determined by a line area rate vs. a sensor output of an amount of adhering toner when test patches of the present invention are adopted;

FIG. 7 is a graph showing a relationship between approximate values of a sensor output of an amount of adhering toner and a developing bias property for a line area rate of 100% based on FIG. 6; and FIG. 8 is a flow chart used for the present invention.

DESCRIPTION OF THE PREFERRED EMBODIMENTS

An image forming apparatus of the present invention is adopted for an image forming apparatus such as a copying machine, a printer, a facsimile or a multiple device having those functions to form an image by an electrophotographic process. The image forming apparatus of the present invention is also adopted for a color image forming device and a monochrome image forming device.

FIG. 1 is a configuration showing an image forming unit 100 in an image forming apparatus of the present invention. The image forming apparatus comprises a photoconductor 1 and a charging means 2, a light exposure means 3, a developing means 4, an image transfer means 5 and a cleaning means 6 which are peripherally disposed to the photoconductor 1, and is also provided with a fixing means 7. A recording paper 8 is transported from a sheet feeder (not illustrated) through a delivery path in timing with the image transferred by the image transfer means 5. Toner is then fixed onto the recording paper 8 by the fixing means 7, and the recording paper 8 is discharged outside of the image forming apparatus. In FIG. 1, although the recording paper 8 is illustrated like a long series of paper for the convenience of an illustration, an appropriate size of sheets deliverable by a delivery means may be employed.

The charging means 2 is a device for evenly charging a surface of the photoconductor 1 with a predetermined potential (e.g. −400V to −800V, preferably −500V to −700V) and is provided with a charging bias control unit 2*a* and a charger 2*b*. The charging means 2 controls a surface potential of the photoconductor 1 by using the charging bias control unit 2*a*. As a charger, a scorotron charger can be employed. Others may include roller- or brush-type contact charging devices. This embodiment employs a system in which the charging means 2 is connected to a power supply means 11, and a power supply bias is provided from the power supply means 11. The charging means 2 is provided with a grid bias voltage by a grid bias generation unit in the power supply means 11, and the surface of the photoconductor 1 is charged to a surface potential similar to the grid bias voltage by the charging bias control unit 2*a*.

The light exposure means 3 scans and selectively exposes the surface of the photoconductor 1 which is evenly charged by the charging means 2, to light corresponding to image information in an axial direction of the photoconductor 1. By doing so, the surface potential of a region which is exposed to the light becomes −75V or less as an example to form an electrostatic latent image. It is noted that the present invention is applicable to both a regular developing method and a reversal developing method, and the following are the latter method.

The light exposure means 3 scans and exposes the photoconductor 1 to the light in the axial direction. That is, the light exposure means 3 exposes the photoconductor 1 to the light which is modulated into the pulse width, using a control signal. The control signal of the light exposure means 3 is generated in the following manner: a manuscript placed on a manuscript reading table is illuminated; light reflected from the manuscript is guided onto a CCD via an optical part such as a mirror and a lens; the CCD reads an image of the manuscript to produce an image signal; the image signal is then converted into a digital data; and the digital data undergoes image processing to produce the control signal. Alternatively, an image signal obtained from a personal computer or the Internet may be employed. As an exposure light source, a laser, an LED array or a lamp can be used. The light exposure means 3 is provided with a control unit (not illustrated) for controlling exposure energy so as to control exposure power.

The developing means 4 is to provide toner to form a toner image since the electrostatic latent image is visualized on the surface of the photoconductor 1 in a negative or a positive developing manner. In order to develop the image, a dry two-component developing method is employed. The developing means 4 is provided with a developing sleeve 4*a* (FIG. 1 indicating the developing sleeve) abutting on the photoconductor 1 and further with a mixer for mixing toner and carrier inside of a developing part so as to negatively charge the toner with friction. Inside of the developing part, toner supply rollers, a toner supply inlet, and a toner supply bottle are included. The developing sleeve 4*a* is provided with a developing bias by a developing bias generation unit in the power supply means 11. Therefore, when the developing sleeve 4*a* containing the toner comes in contact with or closer to the photoconductor 1 forming the electrostatic latent image, the toner on the surface of the developing sleeve 4*a* is transferred to the electrostatic latent image due to a potential difference between the photoconductor 1 and the developing sleeve 4*a*. The visualization of the electrostatic image is completed thereby.

The image transfer means 5 is disposed opposite to the photoconductor 1 and the recording paper 8 is sandwiched between the image transfer means 5 and the photoconductor 1. The image transfer means 5 receives a power supply of +5 μA as an example from an image transfer current generation unit in the power supply means 11. When a toner image on the surface of the photoconductor 1 comes closer to the image transfer means 5, the toner image electrostatically adhering to the surface of the photoconductor 1 is transferred to a direction of the image transfer means 5 due to a potential difference between the photoconductor 1 and the image transfer means 5. In this case, the recording paper 8 is transported between the photoconductor 1 and the image transfer means 5 by register rollers in timing with the toner image transferred from the photoconductor 1 to the image transfer means 5. In this manner, the toner image is transferred to the recording paper 8.

In this embodiment, the system in which the toner image is directly transferred to the recording paper 8 by the image transfer means 5 has been described and this kind of system is effective in the case of forming a monochrome image. In the case of forming the color image, another system may be employed that an image forming unit 100 shown in FIG. 1 is provided for each color of YMCK, and respective toner images of YMCK formed by the image forming unit 100 are overlapped on top of each other on an intermediate transfer belt so as to create a full-color toner image.

The cleaning means 6 is to collect the toner remaining on the surface of the photoconductor 1, and is composed of a cleaning blade made of urethane rubber in a shape of a plate in such a manner of abutting on the surface of the photoconductor 1. Alternatively, it may be composed of a pair of belt cleaning rollers.

The fixing means 7 melts and pressurizes the toner to fix the toner image on the recording paper 8 by heating and pressurizing the recording paper 8 to which the toner image is transferred.

The power supply means 11 is provided with a transformer, a rectifier, and a converter as examples, and also with a discharge current generation unit for supplying a discharge current and a grid bias to the charging means 2, the grid bias generation unit, the developing bias generation unit for supplying the developing bias to the developing means 4, and the image transfer current generation unit for supplying the image transfer current to the image transfer means 5. The power supply means 11 may be provided with a power source for supplying an electrical power to a heater of a heating roller in the fixing means 7 and a power source for supplying an electrical power to an internal heater in the photoconductor 1.

In order to obtain information that may influence an electrophotographic process, the image forming apparatus of the present invention contains a sensor as described below.

A surface potentiometer 21 is disposed between the light exposure means 3 and the developing means 4 while abutting on the surface of the photoconductor 1 to measure potentials such as a charging unit potential Vd, a light exposure unit potential VL, a residual potential Vs and others on the photoconductor 1. Although a single surface potentiometer 21 may be disposed, a plurality of the potentiometers may be disposed in a width direction of the photoconductor 1 to measure the potentials at predetermined intervals of time along the rotational direction of the photoconductor 1 while the photoconductor 1 is in rotational motion. For the surface potentiometer 21, a vibration capacity type surface potentiometer is employed. This surface potentiometer is to induce signals obtained from AC-modulating capacitance across a probe sensor electrode and the photoconductor 1 using a tuning fork in a probe by bringing the probe sensor electrode closer to the photoconductor 1.

A plurality of sensors 22 for detecting an amount of adhering toner are disposed in a width direction of the photoconductor 1 at a downstream side of the developing means 4 and at an upstream side of the image transfer means 5. The sensor 22 is to measure the amount of the adhering toner based on an amount of light which is obtained in the following manner: a light emitting element irradiates the photoconductor 1 with infrared or visible light, the light reflected from the photoconductor 1 is received by a light receiving element, and the amount of the light is obtained by the light receiving element. It is a so-called photo-interrupter type photoelectric element.

When the intermediate transfer belt is employed, an amount of adhering toner on the intermediate transfer belt may be measured by a reflection type optical sensor at a downstream side of the transfer flow with respect to a primary transfer.

Also, a temperature sensor 23 and a humidity sensor 24 are provided to detect the temperature and humidity of the image forming unit 100. The sensors 23 and 24 may be to measure an atmosphere of an area where the image forming unit 100 is situated, and the sensors 23 and 24 are desirable to be disposed near the photoconductor 1.

Here, a relationship among potentials of the reversal developing method in the electrophotographic process is as follows. First, the photoconductor 1 is evenly charged with a surface potential Vo by the charging means 2, a charged area is then exposed to light by the light exposure means 3, and the exposed area carries the light exposure unit potential VL. A difference between the light exposure unit potential VL and a developing bias voltage Vb (Vb−VL) is called a developing potential, and an amount of toner which is proportional to a value of the developing potential adheres to the surface of the photoconductor 1 before development is carried out. When the toner adhering to the surface of the photoconductor 1 is transferred to the recording paper 8, an image is formed on the recording paper 8. In such a case, the amount of the adhering toner varies according to the value of the developing potential. In other words, a relationship among the surface potential of the photoconductor 1, an amount of the charging toner, and the amount of the adhering toner on the photoconductor 1 is that the amount of the toner adhering to the surface of the photoconductor 1 is proportional to the value of the developing potential (Vb−VL), and the amount of the adhering toner is in inverse proportion to the amount of the charging toner.

Generally, the image forming apparatus tends to have a difficulty in charging when a developing agent is used for an extensively long period of time since a negative charge is produced by friction between the developing agent and the toner in the developing part. Therefore, when the developing agent is used for an extensively long period of time and fatigue thereof becomes significant, an amount of charging toner decreases and an amount of adhering toner increases. Inversely, when the amount of the charging toner increases, the amount of the adhering toner decreases. A relationship between the humidity and an amount of adhering toner is that the lower humidity increases the amount of the charging toner and the higher humidity decreases the amount of the charging toner since the negative charge is produced by friction in the developing part.

Also, since the developing sleeve 4*a* and the cleaning means 6 are abutted on the surface of the photoconductor 1, the surface of the photoconductor 1 is scraped off to cause a thin coating film. Particularly, the coating film of a charge transporting layer thins out. Because of this, light attenuation characteristics are changed, and the exposure energy and the developing bias are deviated from the optimal values. As a result, the densities decrease.

Further, transfer densities are changed depending on the image transfer current of the image transfer means 5, and the image densities are changed depending on the heat temperature and pressure of the fixing means 7.

As described above, the amount of the adhering toner is determined by the photoconductor charge potential, the developing bias, the exposure energy, the developing potential, the amount of the charging toner, the image transfer current, the temperature for fixing the toner, the pressure for pressurizing the toner, the atmospheric temperature and humidity and the like.

FIG. 2 is a block diagram of an image forming apparatus of the present invention.

A charging unit 31 in FIG. 2 corresponds to the charging means 2 in FIG. 1 and is connected to a bus line 32 via the charging bias control unit 2*a*. A light exposure unit 33 in FIG. 2 corresponds to the light exposure means 3 in FIG. 1 and is connected to the bus line 32 via an exposure power control unit 34. A developing unit 35 in FIG. 2 corresponds to the developing means 4 in FIG. 1, provides the developing bias to the developing sleeve 4*a*, and is connected to the bus line 32 via a developing bias control unit 4*b*.

The bus line 32 is connected to a CPU 36 which controls respective constituent elements in a sequential manner, practices forming the image, and carries out each step of a method for controlling the image density of the present invention, based on a sequence program for process control 38 stored in a memory 37. The memory 37 is provided with a test patch data storage 39, an image memory 40, and a black solid density data memory 41 for each mode. Outputs of the surface potentiometer 21, the sensor 22 for detecting the amount of the adhering toner, the temperature sensor 23, and the humidity sensor 24 are indicated as an output of a sensor set 42 and are fed into the bus line 32. Also, the image forming apparatus of the present invention is provided with a linear approximation means 43 and a comparator 44.

Detailed descriptions of the test patch data storage 39, the black solid density data memory 41 for each mode, the linear approximation means 43 and the comparator 44 will be given below.

Hereinafter, a reference test pattern used for the image forming apparatus of the present invention will be described. The reference test pattern of the present invention for compensating densities is produced by reading test patch data stored in the test patch data storage 39 in the memory 37. Based on the test patch data stored in the test patch data storage 39, the pulse width modulation is conducted to the exposure light source to form an electrostatic latent image of the reference test pattern on the photoconductor 1, and the electrostatic latent image is then visualized by using toner to be a test pattern image. A unit for creating the test pattern image in a manner described above is called a test pattern image creation unit in the claims. An amount of toner adhering to the test pattern image is detected by the sensor 22.

The reference test pattern used for the present invention is shown in FIGS. 3(*a*) to 3(*c*). This reference test pattern is composed of lines drawn on a predetermined test pattern area. The reference test pattern comprises a plurality of test patches having respectively different line area rates of 10%, 30%, and 50% in the test pattern areas. These line area rates are presented as examples, and any rates can be used for the reference test pattern. However, the line area rate of 50% or less is desirable since toner consumption is less, light reflected from the reference test pattern is stronger, and sensor sensitivity is good. If there are two or more reference test patterns having respectively different line area rates, as described below, an amount of adhering toner for a line area rate of 100% can be calculated. However, it is preferable that there are more reference test patterns having respectively different line area rates since the amount of the adhering toner for the line area rate of 100% can be calculated with higher accuracy.

FIG. 3(*a*) shows a test patch having a line area rate of 10%, 3(*b*) shows a test patch having a line area rate of 30%, and 3(*c*) shows a test patch having a line area rate of 50%. In the test patch, the line area rate means a ratio of an area where lines r are drawn to an entire test pattern area s. Therefore, a black solid image indicates the line area rate of 100%, and a plain colorless image indicates the one of 0%.

An appropriate size of one test pattern area s is 10 to 20 mm per side, and a subscanning direction is from a top to a bottom of the test pattern area. As shown in FIG. 3, the lines r are drawn in the subscanning direction of the image forming apparatus, that is, in a rotational direction of the photoconductor 1 or in a direction of transported paper. A plurality of reference test patterns having respectively different line area rates are evenly distributed over the entire surface of the photoconductor 1, corresponding to the sensor 22. In other words, a plurality of the test patches having the respectively different line area rates of 10%, 30%, and 50% are disposed in a width direction of the photoconductor 1 corresponding to the sensors 22, and three to ten test patches are further disposed at even intervals in the rotational direction of the photoconductor 1. For this, if the test patches having respectively different line area rates are disposed in the rotational direction of the photoconductor 1, the image density control can also be implemented in the rotational direction thereof.

If a reference test pattern comprising lines drawn in a main scanning direction is used, a decrease in the image densities at top or bottom end, the so-called chipping at the top or bottom end, is directly affected due to variations in the rotational speed of photoconductor 1. However, this effect can be greatly eased by adopting the reference test pattern comprising lines drawn in a subscanning direction. In other words, when the top or bottom end chipping takes place and the lines are drawn in the subscanning direction, and only part of the top or bottom end of the line r is chipped and the other part thereof is drawn in the usual way; therefore, the other part thereof can be detected. On the other hand, when the lines are drawn in the main scanning direction, a whole line r is chipped and it cannot be detected.

Accordingly, although it is preferable to form the lines r in the subscanning direction, the lines may be necessarily drawn in a uniform direction. For example, the lines may slant at an angle of 5° to 30° with respect to the subscanning direction, and more preferably, the slanting angle is 5° to 10°.

The width of the line r in FIG. 3 is 10 dots or less, preferably 5 dots or less, and the width is desirably 2 dots when reproducibility of a fine line is taken into account. If the line width is 10 dots or more, the toner consumption increases as in the case of the solid patch. Moreover, reflected light from the line portions significantly decreases and the sensitivity of the sensor is degraded.

In FIG. 4(*a*), a relationship between a line area rate and a sensor output of an amount of adhering toner for each of three test patches having the line area rates of 10%, 30%, and 50% is shown. In FIG. 4(*a*), measurement results of the sensor outputs of the amount of the adhering toner are marked on a graph using symbols of a diamond shape, a square, a triangle, a circle, and a star shape when the surface potential Vo of the photoconductor is fixed to −600V and the developing bias Vb is changed as a parameter from −275V, −300V, −325V, −350V to −375V. In FIG. 4(*a*), a horizontal axis indicates the line area rate while a vertical axis indicates the sensor output of the amount of the adhering toner on an arbitrary scale where no adhering toner is marked as 100. A line a indicates a linear approximated line of the sensor output of the amount of the adhering toner for the three test patches having the line area rates of 10%, 30%, and 50% at the developing bias of −275V. From this linear approximated line of the line a, an approximated value of 6.6 of the sensor output of the amount of the adhering toner can be obtained for the line area rate of 100%.

Similarly, from linear approximated lines of lines b, c, d, and e, approximated values of −18.1, −41.3, −51.0, and −64.5 of the sensor outputs of the amount of the adhering toner for the line area rate of 100% are obtained.

Approximated values obtained in this manner are tabulated in Table 1 of FIG. 4(*b*). In Table 1, the amounts of the adhering toner (mg/cm$^2$) for the line area rate of 100% are indicated together with the developing bias and the approximated values of the sensor outputs.

The linear approximated lines a to e as described above are presented as examples, and different linear approximated lines corresponding to test patches having respectively different line area rates and respectively different developing biases can be obtained.

As shown in FIG. 4(*b*), measurement results of the amounts of the adhering toner per unit area for the line area rate of 100% (i.e., the solid image) where the developing bias voltages of −275V, −300V, −325V, −350V, and −375V are 0.15, 0.40, 0.53, 0.66, and 0.80 mg/cm$^2$, respectively.

In summary, it is understood that the relationship between the approximated value of the sensor output of the amount of the adhering toner for the line area rate of 100% and the amount of the adhering toner is almost linear as shown in FIG. 5. Therefore, FIG. 5 shows a relationship between a target sensor output of the amount of the adhering toner and a target amount of the adhering toner.

The image forming apparatus of the present invention is provided with the black solid density data memory 41 for each mode, which stores target sensor output-values for a normal mode and a toner save mode. That is, the target amount of the adhering toner for the normal mode is 0.50 mg/cm$^2$, and the target sensor output value for it is −32.8. The target amount of the adhering toner for the toner save mode is 0.40 mg/cm$^2$, and the target sensor output value for it is −21.6. Any modes other than the above can be specified such as an extra fine mode, a photo mode, and a mixed mode.

Based on the relationships shown in FIGS. 4 and 5, process control is carried out in the following manner.

The amount of the adhering toner is measured by the sensor when the surface potential Vo of the photoconductor is fixed to −600V, three test patches having respectively different line area rates of 10%, 30%, and 50% are created, and the developing bias Vb is changed as a parameter from −275V, −325V to −375V. Properties determined by the line area rate vs. the sensor output of the amount of the adhering toner are obtained as shown in FIG. 6 from the above measurement results. Sensor output values x, y, and z of the amount of the adhering toner for the line area rate of 100% are obtained by approximating each output of the parameter.

The sensor output values of x, y, and z are marked on a graph in FIG. 7 showing the sensor output value of the amount of the adhering toner vs. the developing bias for the line area rate of 100%. Then, a line h approximately connecting x, y, and z, is drawn.

Since the sensor output of the amount of the adhering toner for the developing bias of 600V in the case of the normal mode is determined to be −32.8 in the image forming apparatus of the present invention and is stored in the black solid density data memory 41 for each mode, the developing bias Vb is −309V from the line h in FIG. 7. Similarly, in the case of the toner save mode, since the sensor output of the amount of the adhering toner is determined to be −21.6, the developing bias Vb is −295V from the line h in FIG. 7.

According to the above results, the developing bias Vb can be estimated based on the linear approximation by using the test patches having respectively different line area rates of 10%, 30%, and 50% even in a case of the different amount of the adhering black solid toner. In other words, the line h can be drawn based on the densities of the two test patches having the respectively different line area rates, and if there are three test patches, the line h can be more accurately drawn.

The image forming apparatus of the present invention has been described. When the image forming apparatus is in an operating state, it is determined whether a timing condition is met or not in Step S1 for the process control to carry out the density compensation. The timing for the density compensation is: before shipping from a factory; at the time of photoconductor replacement; at the time of developing agent replacement; at the time of regular maintenance; at the time of troubleshooting such as paper jamming; at the time of initial power-up for a day; upon completion of operation for the predetermined number of sheets (for example, every 1,000 sheets or 10,000 sheets); once a week; once a month; and every time the temperature or humidity increases or decreases by 5°. The process control is specifically carried out when a service person works on inspection, repairs or replacement such as photoconductor replacement, developing agent replacement, regular maintenance, trouble shooting for paper jamming, and when detecting a power-up detection signal, a count value signal indicating the number of printed paper counted by a counter, and an output signal from the temperature sensor or humidity sensor. The density compensation may be carried out at all timing mentioned above or may be carried out selectively in the course of the process control at the time of the initial power-up for a day, upon completion of the predetermined number of sheets to be printed, or if a temperature or humidity change exceeds a predetermined value. S1 is repeatedly carried out until the above timing is detected.

When it is determined that the timing condition is met for the density compensation, the CPU 36 reads the test patch data from the test patch data storage 39 in the memory 37 to create the reference test pattern in Step S2. Then, three test patterns having respectively different line area rates of 10%, 30%, and 50% are created. In Step S3, the CPU 36 enables the charging means 2 to evenly charge the photoconductor 1, the light exposure means 3 exposes the reference test pattern image to light, and the developing means 4 forms the reference test pattern image. In Step S4, the amount of the toner adhering to the reference test pattern image formed on the photoconductor 1 is detected by the sensor 22. Outputs obtained thereby are image density values for the line area rates of 10%, 30%, and 50%.

In Step S5, a black solid density is calculated based on the density values for the line area rates of 10%, 30%, and 50%. The calculation is performed by the linear approximation means 43 for the line area rate of 100% based on the density values for the line area rates of 10%, 30%, and 50%. Explicitly, the properties determined by the line area rate vs. the sensor output of the amount of the adhering toner are drawn on a graph as shown in FIG. 6, and the amount of the adhering toner for the line area rate of 100% is calculated. However, the linear approximation means 43 works on actual calculation for this.

In Step S6, properties determined by the approximated values of the sensor output of the amount of the adhering toner vs. the developing bias are drawn on a graph as shown in FIG. 7. In fact, the CPU 36 in the image forming apparatus computes this process. In Step S7, the image forming apparatus reads the target sensor output value for the black solid density specified in an operating mode from the black solid density data memory 41 in the memory 37. In Step S8, the properties determined by the approximated values of the sensor output of the amount of the adhering toner vs. the developing bias for the line area rate of 100% created in S6 is referenced by using the target sensor output value read in S7 in order to obtain the developing bias, and then a new developing bias is attained. In accordance with the new developing bias, the developing bias voltage is adjusted in Step 59 and the whole process is completed.

Although a case of adjusting the developing bias has been described in the above embodiment, the target amount of the adhering toner is obtained by adjusting the grid bias of the charger or an amount of the light exposure in other embodiments.

What is claimed is:

1. An image forming apparatus comprising:

a test pattern image creation unit for creating a test pattern image by adhering toner to a plurality of test patches having respectively different line area rates of 100% or less;

a detection unit for detecting an amount of the toner adhering to the test pattern image;

a calculation unit for calculating the amount of the adhering toner for the line area rate of 100%, based on the amount of the adhering toner detected by the detection unit; and a control unit for controlling process conditions so that the amount of the adhering toner obtained by the calculation unit reaches a predetermined value.

2. The image forming apparatus according to claim 1, wherein the test pattern image comprises two or more test patches having respectively different line area rates of 50% or less.

3. The image forming apparatus according to claim 1, wherein a line direction composing the plurality of test patches is approximately in a subscanning direction.

4. The image forming apparatus according to claim 1, wherein lines composing the plurality of test patches comprise two to ten dots in width.

5. The image forming apparatus according to claim 1, wherein a plurality of the test pattern images are arranged corresponding to a plurality of sensors for the amount of the adhering toner, disposed in a width direction of a photoconductor.

6. The image forming apparatus according to claim 1, wherein the calculation unit calculates the amount of the adhering toner for the line area rate of 100% by linear approximation based on the amount of the adhering toner detected by the detection unit.

7. The image forming apparatus according to claim 1, wherein the process conditions are at least one of developing bias, photoconductor charge potential, exposure energy, and image transfer current.

8. A method for controlling an image density of an image forming apparatus includes:

a creation step for creating a test pattern image by adhering toner to a plurality of test patches having respectively different line area rates of 100% or less;

a detection step for detecting an amount of the toner adhering to the test pattern image;

a calculation step for calculating the amount of the adhering toner for the line area rate of 100%, based on a result of the detection step; and a control step for controlling process conditions so that the amount of the adhering toner obtained in the calculation step reaches a predetermined value.

9. A method for controlling an image density of an image forming apparatus that carries out the method for controlling the image density of claim 8 at timing of process control.

10. A recording medium storing a computer program accessible from a computer to implement each of the steps in claim 8.

* * * * *